United States Patent [19]

Ahern et al.

[11] 4,026,078

[45] May 31, 1977

[54] SPHERICAL STRUCTURAL ARRANGEMENT

[75] Inventors: William W. Ahern, Belmont; Birgit T. Mathe, Cambridge, both of Mass.

[73] Assignee: GeoMetrics, Cambridge, Mass.

[22] Filed: Feb. 9, 1976

[21] Appl. No.: 656,340

[52] U.S. Cl. ..... 52/81

[51] Int. Cl.[2] ..... E04B 1/32

[58] Field of Search ..... 52/80–82, 52/DIG. 10

[56] References Cited

UNITED STATES PATENTS

| | | | |
|---|---|---|---|
| 2,978,704 | 4/1961 | Cohen | 52/81 |
| 3,154,887 | 11/1964 | Schmidt | 52/81 |
| 3,392,495 | 7/1968 | Ahern | 52/81 |
| 3,740,903 | 6/1973 | Ahern | 52/81 |

*Primary Examiner*—Ernest R. Purser
*Assistant Examiner*—Henry Raduazo
*Attorney, Agent, or Firm*—Thompson, Birch, Gauthier & Samuels

[57] ABSTRACT

A self-supporting radome construction is formed from a random distribution of four basic structural elements assembled in a standard reoccurring pattern. The elements define four basic triangular openings. Each triangular opening is covered with a panel, and only four panel sizes are required whether or not the interior surface is the same or different than the exterior surface.

8 Claims, 13 Drawing Figures

SPHERICAL STRUCTURAL ARRANGEMENT

BACKGROUND AND BRIEF SUMMARY OF THE INVENTION

This invention relates to an improved frame construction for self-supporting spherical enclosures, and is particularly concerned with self-supporting structures ofthe type commonly referred to as "radomes."

A self-supporting radome construction is disclosed in U.S. Pat. No. 3,392,495. In that disclosed structure, a random distribution of structural elements is provided which employs a limited number of different-sized structural components without adversely affecting the performance of radar equipment enclosed therein. Further, that structure provides for a random distribution of structural elements or struts being divided into four basic groups. A typical structure in accordance with U.S. Pat. No. 3,392,495 was nineteen panels per section and twenty triangular sections per dome. Further, where the inner surface of the radome differs from the outer surface a maximum of five different panels are required, because although only four basic panel groups are required, one of the groups is unequally shaped and two sets must therefore be provided, one the mirror image of the other.

The present invention provides a radome construction which is an improvement of the radome construction disclosed in U.S. Pat. No. 3,392,495. Our invention decreases the number of individual panels required, the kinds of panels and the number of structural elements or struts. This results in reduced manufacturing, shipping, and erection costs.

More particularly, in the aforementioned patent where the exterior finish is different than the interior finish, five basic size panels are required for construction. With the present inventionn, only four panel sizes are necessary regardless of the surface finish required. In the present invention, the configuration of panels also results in fewer panels required for each triangular area.

In the preferred embodiment of the invention, four baasic triangular openings are formed utilizing four basic elements. The triangular openings are interconnected in a standard reoccurring pattern. Each pattern comprises three first isosceles triangles, three equilateral triangles, three second isosceles triangles, a fourth equilateral triangle and three identical irregular triangles.

Each of the first isosceles triangles has a vertex located at one of the vertices of an imaginary spherical triangular subdivision. One side of each of the three equilateral triangles is equal and parallel to the base of each of the first isosceles triangles. The vertices of the fourth equilateral triangle are common to a vertex of each of the three equilateral triangles.

The three second isosceles triangles each have one side equal and parallel to one side of the three equilateral triangles and the other side equal and parallel to one sideof the fourth equilateral triangle.

The three identical irregular triangles each have a side extending from the common vertices of the three equilateral triangles and the fourth equilateral triangle, which side extends through an equal distance beyond the sides of the imaginary triangular subdivision. Another side is equal and parallel to a side of each of the three equilateral triangles.

DESCRIPTION OF THE PREFERRED EMBODIMENT

Figure 1:
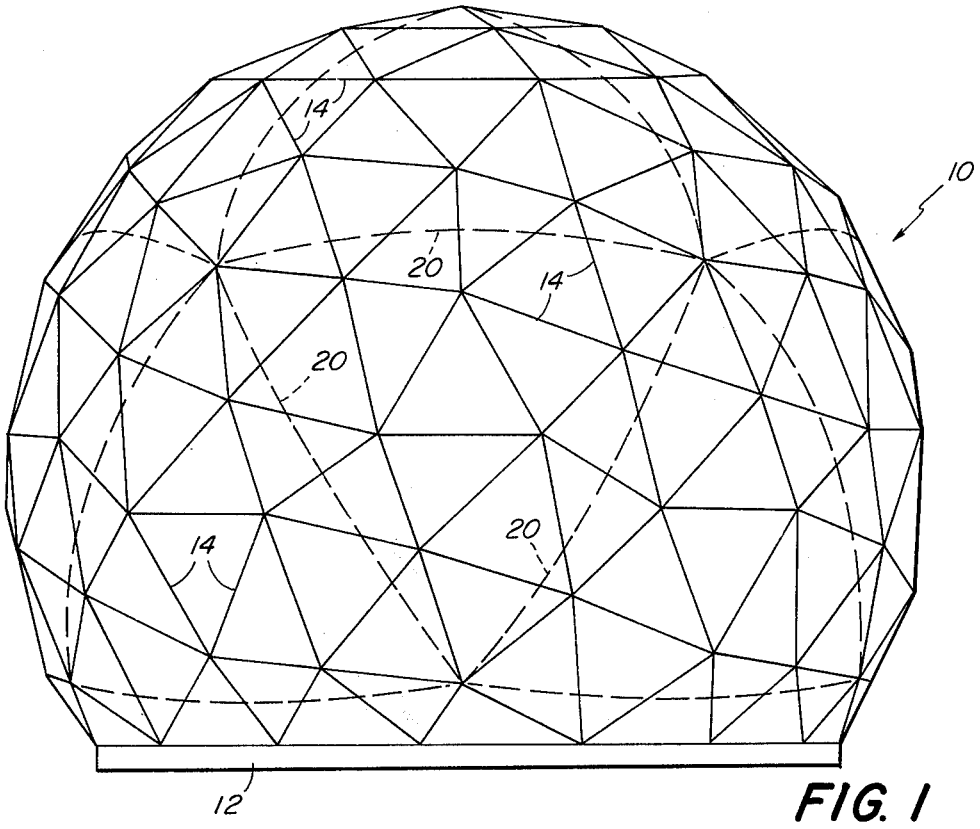
FIG. 1 is a diagrammatic view in side elevation of a radome frame construction embodying the principles of the present invention.

Referring to FIg. 1, the basic framework of a substantially spherical self-supporting radome structure generally indicated by the reference numeral 10 is shown mounted in a conventional manner on a circular base 12. Radome 10 has been illustrated diagrammatically with the random disposition of its basic structural elements indicated typically by the reference numeral 14 shown in simple line form.

Figure 2:
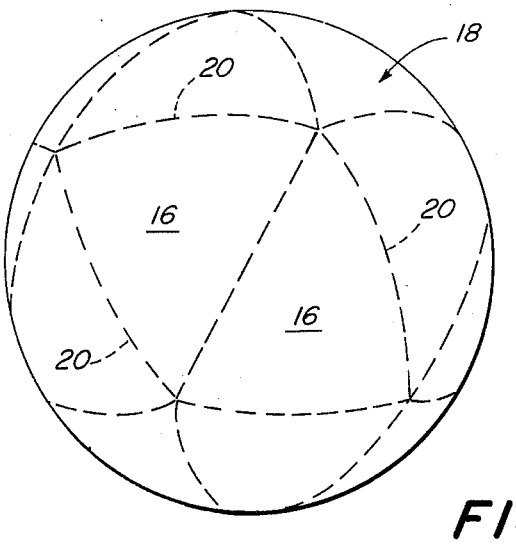
FIG. 2 is a view in perspective of a spherical body with its surface divided into a predetermined number of spherical equilateral triangular subdivisions.

In structures of this type a random disposition of structural elements is essential if the enclosed radar equipment is to function properly. The random distribution of the structural elements are interconnected in accordance with a carefully developed standard random pattern which is repeated over the entire surface of the sructure. This standard pattern, a more complete description of which will hereinafter be provided, is contained almost entirely within one of a plurality of large spherical equilateral triangular subdivisions 16, having sides 20 which are emphasized by heavier dotted lines, as shown in FIG. 2.

The aforementioned standard random pattern (shown on an enlarged scale in FIG. 4), is geometrically developed by following a series of steps. Thefirst of these steps involves subdividing the surface of the spherical structure 10 into the aforementioned basic spherical equilateral triangular subdivisions 16. This technique is illustrated in FIG. 2 which shows the surface of a typical spherical body 18 subdivided into the equilateral triangles 16, the sides 20 shown as dotted lines. It is to be understood at this point that the large triangular areas 16 defined by heavy dotted lines 20 in FIG. 1 correspond to the identically numbered triangular subdivisions in FIG. 2. The spherical equilateral triangles 16 provide a basis for developing the standard pattern which will govern the ultimate random arrangement of individual structural elements. Thus, it can be seen that once a standard pattern has been developed for one such basic triangular subdivision, the same pattern will apply equally as well to the remaining triangular subdivisions into which the surface of the spherical structure has been divided.

Figure 3:
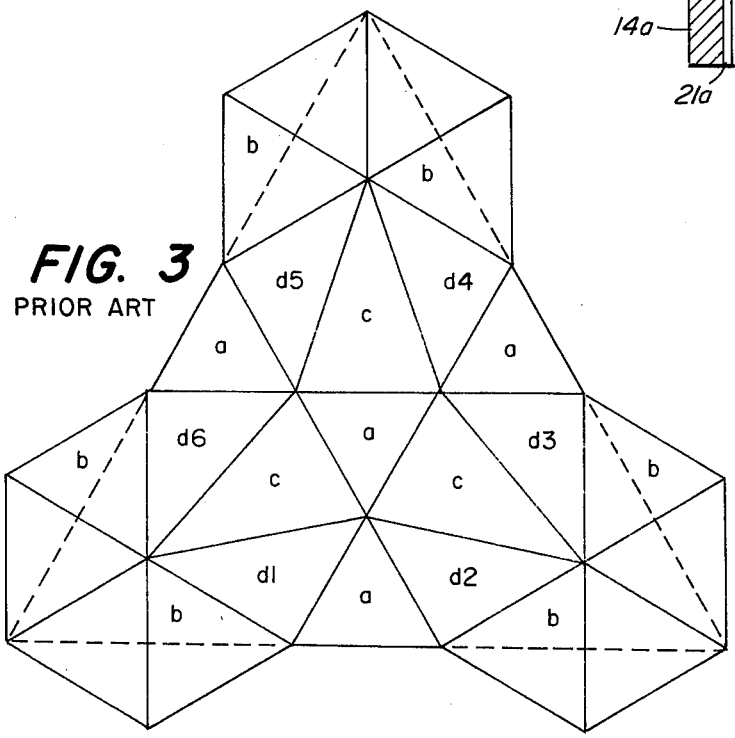
FIG. 3 PRIOR ART
FIG. 3 is a diagrammatic illustration of the random pattern established in accordance with U.S. Pat. No. 3,392,495.

Similar steps were followed in the development of the random pattern disclosed in U.S. Pat. No. 3,392,495. In that pattern where the outer surface was different from the inner surface five basic panels were required. Referring to FIG. 3, (which corresponds to FIG. 3 of that patent), the five basic panels are identified as *a; b; c;* $d_1$, $d_3$, $d_5$; and $d_2$; and $d_2$, $d_4$, $d_6$. Panels $d_1$, $d_3$, $d_5$ are identical irregular triangles and panels $d_2$, $d_4$, $d_6$ are identical irregular triangles which are mirror images of panels $d_1$, $d_3$, $d_5$.

Figure 4:
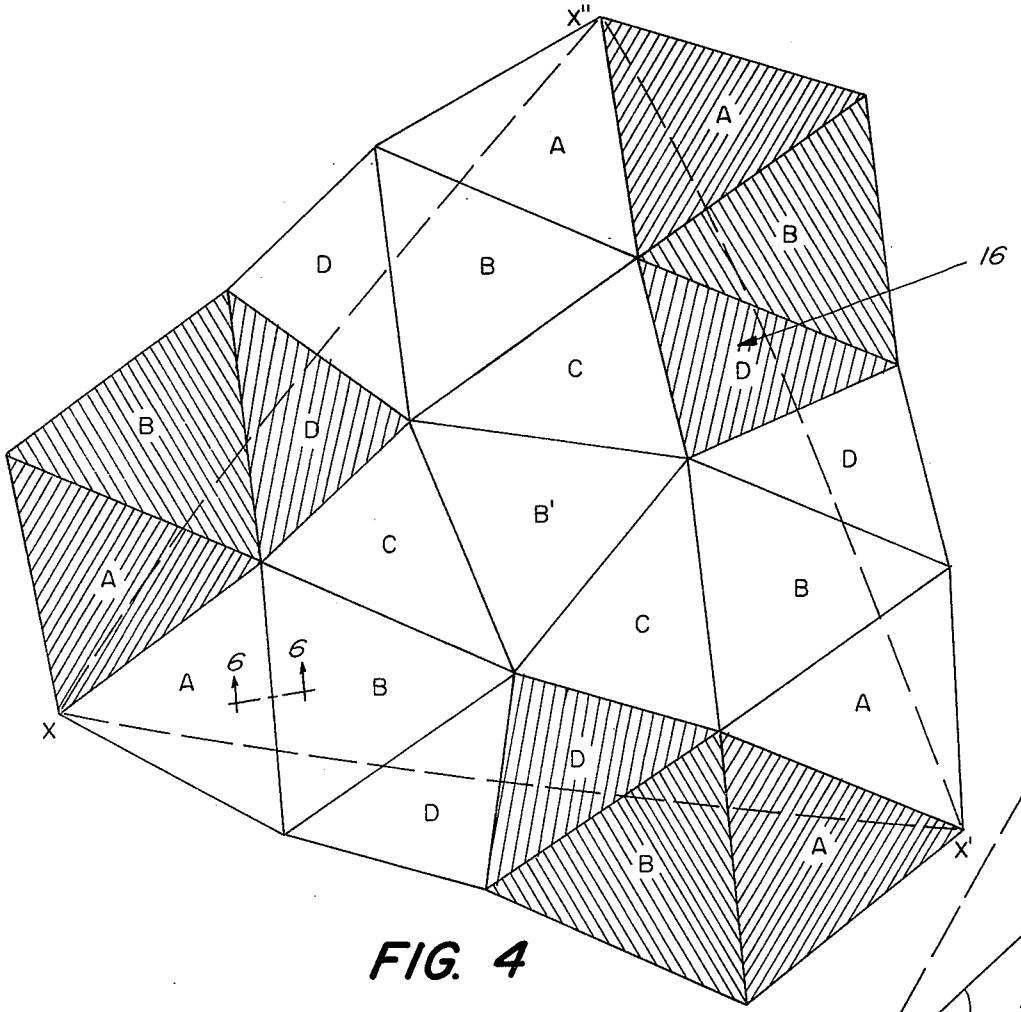
FIG. 4 is a diagrammatic view showing a random pattern established in accordance with the present invention.

In the present invention, only four basic panels are required. Referring to FIG. 4, the four basic panels are identified as A, B, C, and D.

Figure 5:
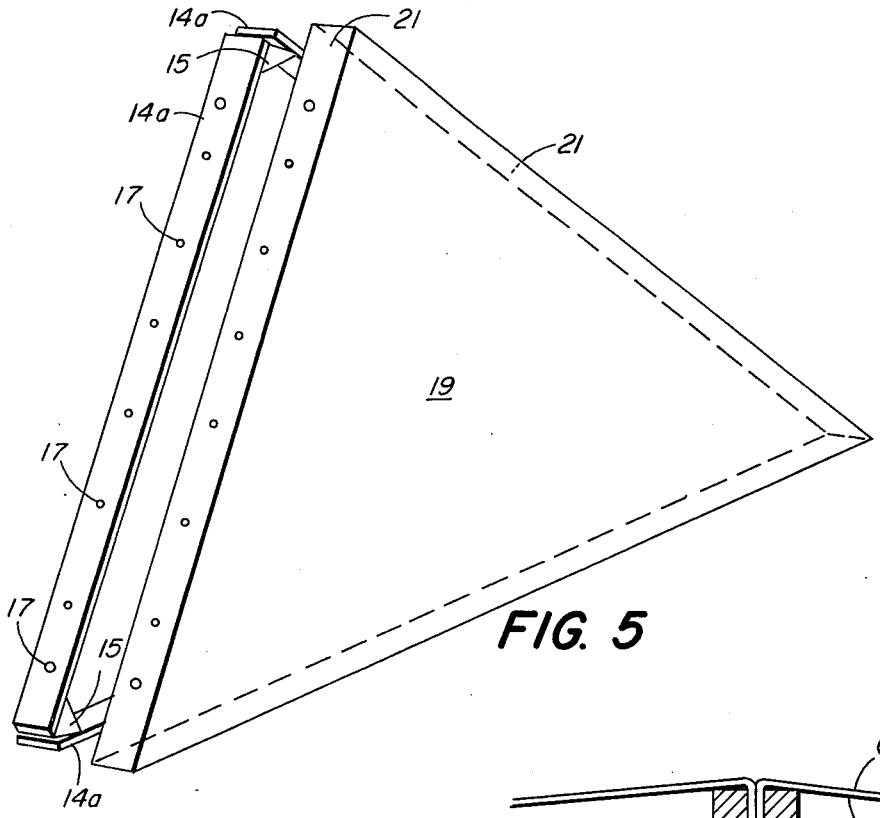
FIG. 5 is a perspective view of the structural elements assembled in triangular form with a mating panel member.

In FIG. 4, one of the basic spherical triangular subdivisions 16 shown in FIG. 1 has been divorced from the remainder of the structure and shown alone with the standard pattern governing the random disposition of the four basic panels superimposed thereon. In FIGS. 2 and 4, the structural elements 14 are shown in simple line form. The fabrication of the individual panels A, B, C, and D is shown more clearly in FIG. 5. The fabrication of only one panel will be described in detail. Structural elements 14*a* are secured at their ends to wedges 15 such as by welding to form a triangle frame. The elements 14*a* are characterized by a plurality of apertures 17 therein. a membrane 19 has a depending apertured flange 21 about its perimeter. The triangular frame is received within the apetured flange 21*a* to form a panel such as A, B, C, or D.

Figure 6:
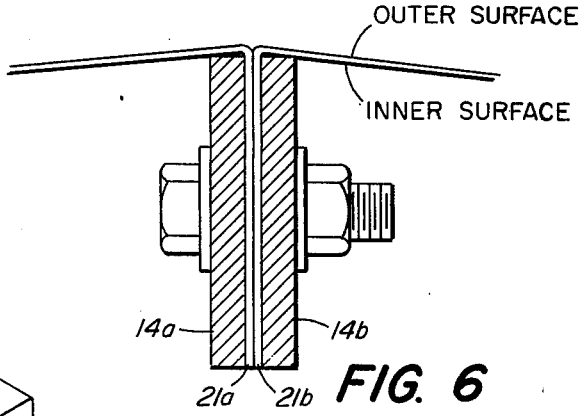
FIG. 6 is a sectional view taken along line 6—6 of FIg. 4.

Referring to FIG. 6, a typical method of securing adjacent panels is more clearly shown. Flanges 21*a* and 21*b* are abutted along their entire length and sandwiched between structural elements 14*a* and 14*b*. The apertures of the flanges 21*a* and 21*b* and the elements 14*a* and 14*b* are in register and the flanges and members are bolted together along the length of the sides of the panels.

In the following description, the standard pattern is formed using four basic triangular panels. In practice, the sids of adjacent triangular panels are abutted and bolted together. For clarity, only one line will be used to illustrate the abutting adjacent sides of the triangular panels. Further, the triangular panels will be described simply as triangles and where the sides are of equal length the same numerical designation is used.

Figure 7A:
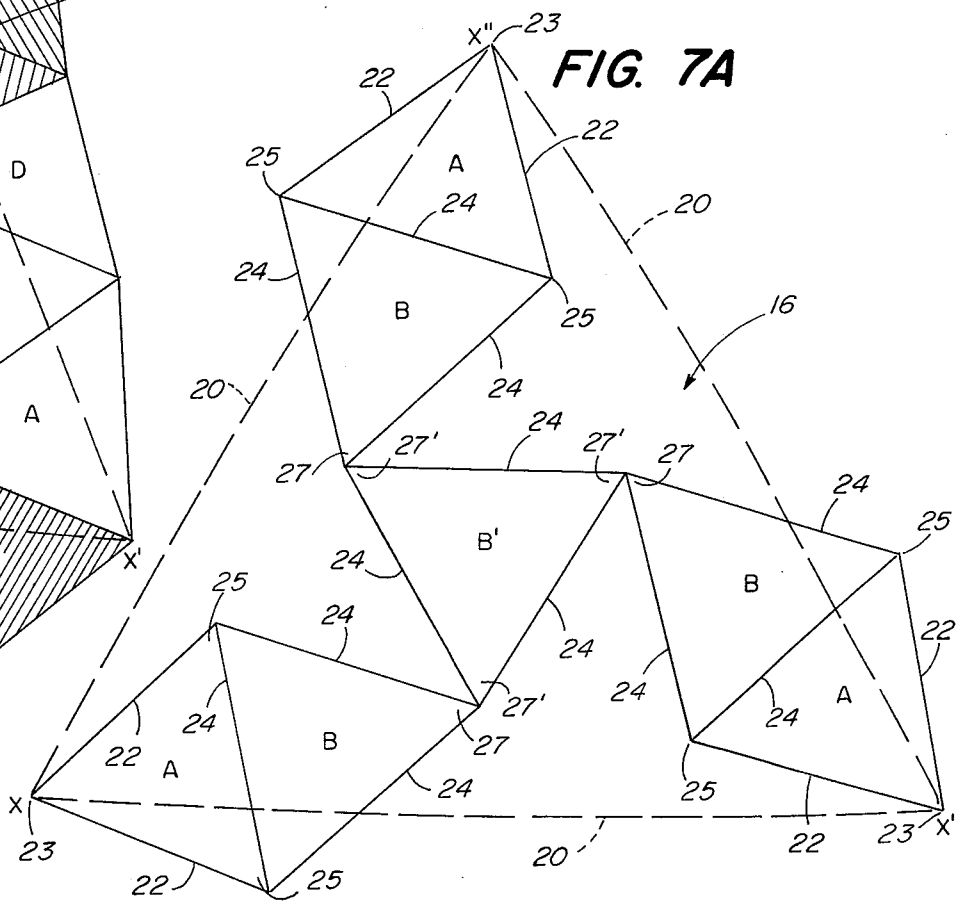
FIGS. 7A to 7C are diagrammatic views depicting the series of successive steps followed in establishing the random pattern illustrated in FIG. 4.
Figure 7C:
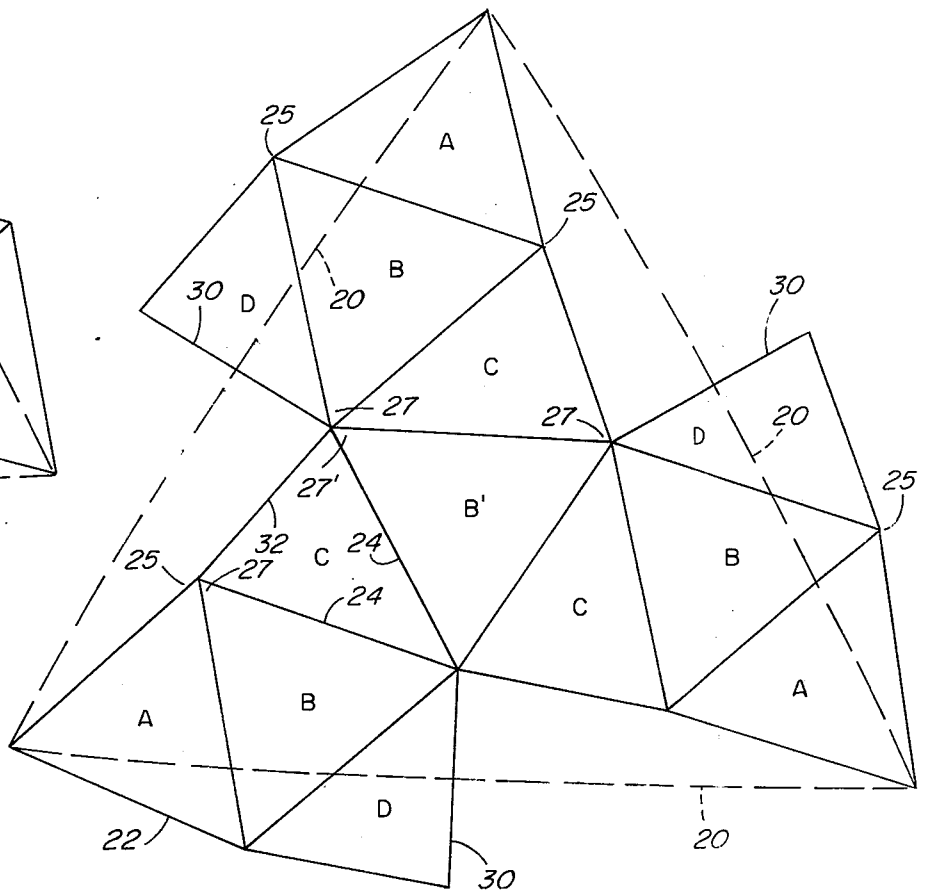
Figure 7B:
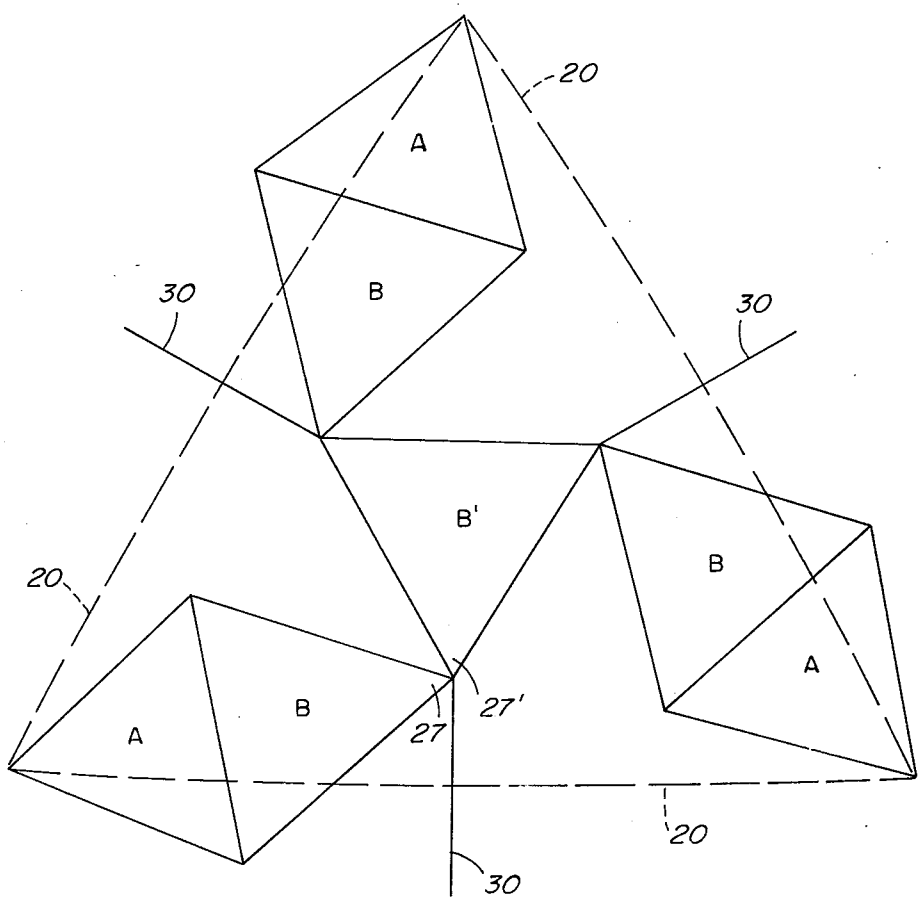
Figure 8A:
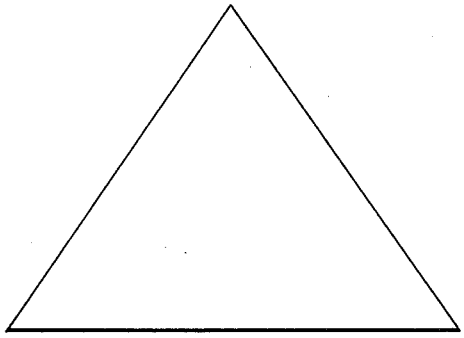
FIGS. 8A to 8D are illustrations showing the maximum number of triangular panels required to enclose the frame structure shown in FIG. 1.
Figure 8C:
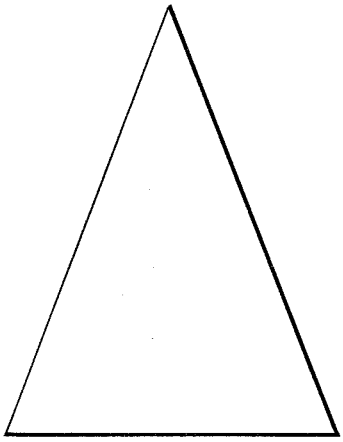
Figure 8B:
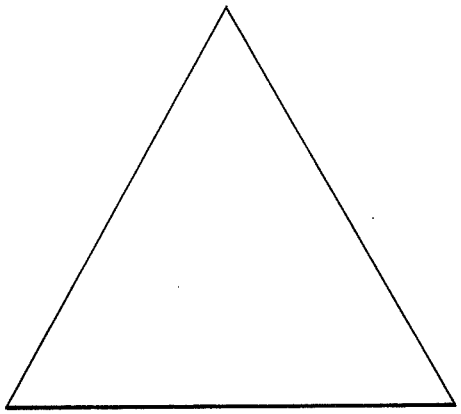
Figure 8D:
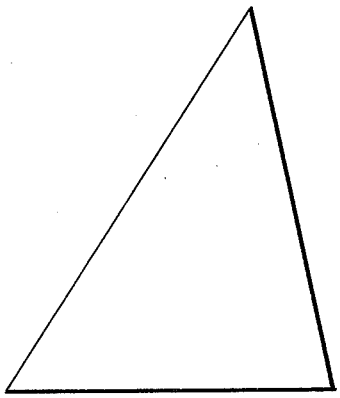

Referring to FIGS. 7A-C, the same triangular subdivision 16 of FIG. 4 is also shown at various stages in the geometric development of the standard pattern. The triangular subdivision 16 is shown with the sides 20 represented by dotted lines which intersect to form three vertices X, X′ and X″.

In FIG. 7A are first ososceles triangles A, each having sides 22 and a base 24. Vertices 23 are formed by the sides 22 and are located at points X, X′ and X″. Vertices 25 are formed by the sides 22 and the bases 24. Identical equilateral triangles B are then formed, the bases 24 of the triangles A being adjacent and equal to one side of each of the triangles B. The other two sides of the equilateral triangles B, being of equal length, are also designated 24 and form vertices 27. The size and position of the A-B triangle combinations are adjusted in a symmetrical manner such that the three inner vertices 27 of the B triangles are common to the vertices 27′ of an equilateral triangle B′ having side lengths 24 equal to equilateral triangles B.

FIG. 7B shows the next step in the development of the standard pattern. From each of the adjacent vertices 27—27′ a side 30 extends through the midpoint of the sides 20 and exends an equal length beyond the sides 20. Preferably, side 30 is normal to side 20.

In FIG. 7C, the final steps are accomplished by forming second isosceles triangles C and irregular triangles D. The second isosceles triangles C include sides 24 adjacent and equal to the opposed sides 24 of the equilateral triangles B and B′. The bases 32 of the triangles C extend from the one end of the side 30 adjacent vertices 27—27′ to verticles 25–27 of the adjacent triangles A and B. Sides 24 extend from the other end of the side 30 to vertices 25–27 of the adjacent triangles A and B. Each triangle D comprises side 30; side 32, which is adjacent to the bases 32 of the triangles C; and side 24.

In FIG. 4, the standard random pattern is more clearly illustrated. The contiguous triangles of the next succeeding random pattern are shaded.

By arranging structural members along the lines defined by the sides of the triangles A, B, C and D, only four basic members equal to the sides 22, 24, 30 and 32 are required. The A triangles are isosceles and utilize the two equal sides 22, the first basic element length, and share with the equilateral triangles B the common side 24, the second basic element length. The C triangles are also isosceles and utilize the equal sides 24 of the adjacent equilateral triangles B. The third side 32 on the base of the triangle C is the third basic element length. Finally, the irregularly dimensionsed D triangles are formed by the sides 30, the fourth basic element length and the sides 24 and 32.

Where the triangular panels are individually fabricated, a maximum of four different panels will be required as shown in FIG. 8 regardless of whether or not the interior finish of the structure 10 is the same as the exterior.

This relatively low number of differently dimensioned structural elements is of significant importance both in the fabrication and subsequent construction of radome structures. More particularly, when fabricating differently dimensioned elements, jigs and fixtures must be designed for each element in order to facilitate mass production. By minimizing the number of differently dimensioned elements, a comparable reduction is realized in the various jigs and fixtures required, thereby giving rise to a substantial saving in tool costs. Moreover, the low number of differently dimensioned components facilitates subsequent shipment of a radome structure in a disassembled state. Finally, the task of assembling the radome structure at the construction site is considerably simplified by the reduction in number of differently dimensioned components. This is of considerable importance when one considers that most radome structures are assembled at remote construction sites, often under severe climatic conditions which predominate in arctic regions.

Although described in connection with radomes, it is to be understood that the invention applies to all types of spherical enclosures.

What we claim is:

1. A self-supporting spherical structure of elongated structural elements arranged in reoccurring geometric patterns, the elements in each of said patterns cooperating to define a plurality of four basic triangular openings, said elements having four basic lengths which are utilized repeatedly in said pattern, the elements defining said triangular openings being interconnected in a standard random pattern, each of said standard patterns being comprised in part of:

three isosceles triangles (A) each havinga vertex (23), equal side elements (22) and a base element (24), each of said vertices (23) being located at one of the vertices (X, X', X'') of an imaginary spherical triangular subdivision (16) having sides (20);

three equilateral triangles (B) each having side elements (24) equal in length to the base element (24) of said isosceles triangles (A), said equilateral triangles (B) each having one side element (24) parallel to the base element (24) of one of said isosceles triangles (A); and a fourth equilateral triangle (B') identical to said equilateral triangles (B), said fourth equilateral triangle having each of its vertices (27') common to one vertex (27) of one of said equilateral triangles (B).

2. The structure of claim 1 wherein the isosceles triangles (A) are first isosceles triangles and which comprises:

three second isosceles triangles (C) each having equal side elements (24) and a base (32), one of the side elements (24) of each second isosceles triangles (C) being parallel and equal to a side element (24) of each of the three equilateral triangles (B) and the other of the side elements (24) of each second isosceles triangle (C) being parallel and equal to a side element (24) of the fourth equilateral triangle (B').

3. The structure of claim 2, which comprises:

three equal irregular triangles (D), each of said triangles having:

a first side (30) extending from the common vertices (27,27') of the equilateral triangles (B,B') through the sides (20) of the triangular subdivision (16) and an equal distance beyond said sides (20);

a second side (24) being parallel and equal to a side (24) of each of the three equilateral triangles (B); and a third side (32) completing the triangles.

4. A self-supporting spherical structure of elongated structural elements arranged in re-occurring geometric patterns, the elements in each of said patterns cooperating to define a plurality of four basic triangular openings, said elements having four basic lengths which are utilized repeatedly in said pattern, the elements defining said triangular openings being interconnected in a standard random pattern each standard pattern comprising at least one first and one second isosceles triangle, first and second identical equilateral triangles, the first equilateral triangle having one side and another side, the base of the first isosceles triangle adjacent and equal to one side of the first equilateral triangle, the triangles oriented such that a vertex of the first equilateral triangle is adjacent to a vertex of the second equilateral triangle and two sides of the equilateral triangles are opposed, and the sides of the second isosceles triangle are adjacent and equal to the opposed sides of the first and second equilateral triangles.

5. The structure of claim 4, wherein the standard pattern comprises at least an irregular triangle having a side adjacent and equal to the other side of the first equilateral triangle.

6. The structure of claim 4 wherein the standard pattern comprises third and fourth identical equilateral triangles, each having one side and another side, the third and fourth equilateral triangles orientated such that each equilateral triangle has a vertex adjacent a vertex of the second equilateral triangle and a side opposed to a side of the second equilateral triangle, and first isosceles triangles having bases adjacent and equal to the one side of the third and fourth equilateral triangles.

7. The structure of claim 6 wherein the standard pattern comprises second isosceles triangles each having sides adjacent and equal to the opposed sides of the second and first, and third and fourth equilateral triangles respectively.

8. The structure of claim 6, wherein the standard pattern comprises three equal irregular triangles, each having a side adjacent and equal to the other sides of the first, third and fourth equilateral triangles.

* * * * *

UNITED STATES PATENT OFFICE

CERTIFICATE OF CORRECTION

Patent No. 4,026,078 Dated May 31, 1977

Inventor(s) William W. Ahern et al.

It is certified that error appears in the above-identified patent and that said Letters Patent are hereby corrected as shown below:

"[73] Assignee: GeoMetrics" should be -- Geometrics Inc. Cambridge, Mass. --.

Col. 1, line 9 - "ofthe" should be -- of the --.

Col. 2, line 19 - "FIg." should be -- FIG. --.

Col. 2, line 29 - "FIg." should be -- FIG. --.

Col. 2, line 44 - "sructure" should be -- structure --.

Col. 2, line 52 - "Thefirst" should be -- The first --.

Col. 1, line 44 - "baasic" should be -- basic --.

Col. 3, line 9 - "and $d_2$" (first occurrence) should be deleted

Col. 3, line 28 - "a" (first occurrence) should be -- A --.

Col. 3, line 30 - "apetured" should be -- apertured --.

UNITED STATES PATENT OFFICE

CERTIFICATE OF CORRECTION

Patent No. 4,026,078 Dated May 31, 1977

Inventor(s) William W. Ahern et al.

It is certified that error appears in the above-identified patent and that said Letters Patent are hereby corrected as shown below:

Col. 3, line 43 - "sids" should be -- sides --.

Col. 4, line 4 - "exends" should be -- extends --.

Col. 4, line 12 - "verticles" should be -- vertices --.

Col. 5, line 4 - "havinga" should be -- having a --.

Signed and Sealed this

*Twenty-seventh* Day of *September 197*

[SEAL]

*Attest:*

RUTH C. MASON
*Attesting Officer*

LUTRELLE F. PARKER
*Acting Commissioner of Patents and Trademarl*